US007913373B2

(12) United States Patent
Herrmann

(10) Patent No.: US 7,913,373 B2
(45) Date of Patent: Mar. 29, 2011

(54) METHOD FOR NON-ROTATABLY CONNECTING A HOLLOW SHAFT WITH A COMPONENT

(75) Inventor: Guenter Herrmann, Guetersloh (DE)

(73) Assignee: CLAAS Fertigungstechnik GmbH, Beelen (DE)

( * ) Notice: Subject to any disclaimer, the term of this patent is extended or adjusted under 35 U.S.C. 154(b) by 585 days.

(21) Appl. No.: 11/507,303

(22) Filed: Aug. 21, 2006

(65) Prior Publication Data

US 2007/0053740 A1 Mar. 8, 2007

(30) Foreign Application Priority Data

Aug. 22, 2005 (DE) ..... 10 2005 039 784

(51) Int. Cl.
*B23P 11/02* (2006.01)

(52) U.S. Cl. ..... 29/507; 29/506; 29/890.053; 72/58; 72/59

(58) Field of Classification Search ..... 29/505, 29/506, 507, 890.053; 72/58, 59
See application file for complete search history.

(56) References Cited

U.S. PATENT DOCUMENTS

| | | | | | |
|---|---|---|---|---|---|
| 616,764 | A | * | 12/1898 | Bourke | 72/59 |
| 3,869,938 | A | * | 3/1975 | Schlotterbeck et al. | 74/567 |
| 4,293,995 | A | * | 10/1981 | Jordan | 29/421.1 |
| 4,660,269 | A | * | 4/1987 | Suzuki | 29/523 |
| 4,781,076 | A | * | 11/1988 | Hartnett et al. | 74/567 |
| 5,081,880 | A | * | 1/1992 | Swars | 74/567 |
| RE33,888 | E | * | 4/1992 | Hartnett et al. | 29/888.1 |
| 5,280,575 | A | * | 1/1994 | Young et al. | 715/255 |
| RE34,565 | E | | 3/1994 | Hartnett et al. | |
| 5,337,476 | A | * | 8/1994 | Orsini, Jr. | 29/888.1 |
| 5,428,894 | A | * | 7/1995 | Orsini, Jr. | 29/888.1 |
| 5,435,207 | A | * | 7/1995 | Orsini, Jr. | 74/567 |
| 5,469,759 | A | * | 11/1995 | Orsini, Jr. | 74/567 |
| 6,125,537 | A | | 10/2000 | Kuehl | |
| 6,347,451 | B1 | | 2/2002 | Bloecker et al. | |

FOREIGN PATENT DOCUMENTS

| | | |
|---|---|---|
| DE | 25 46 802 | 4/1977 |
| DE | 37 01 166 | 7/1987 |
| DE | 37 26 083 | 2/1988 |
| DE | 42 21 962 | 1/1994 |
| DE | 196 25 555 | 1/1998 |
| DE | 198 02 484 | 8/1999 |
| DE | 102 25 688 | 12/2003 |
| EP | 0 650 550 | 1/1996 |

* cited by examiner

*Primary Examiner* — C. J Arbes
(74) *Attorney, Agent, or Firm* — Michael J. Striker

(57) ABSTRACT

In a method and a device for non-rotatably connecting a hollow shaft with at least one component located on the hollow shaft with which the component is positioned with clearance on the hollow shaft and is fastened thereon in a certain position by eliminating the clearance, the clearance being eliminated by expanding the hollow shaft using a joining tool that passes through at least part of the hollow shaft, and the joining tool including at least one first shaping element and at least one further shaping element, and the shaping elements being movable relative to each other, so that the motion of the shaping elements relative to each other causes an at least partial expansion of the hollow shaft. A design of this type has the advantage, in particular, that the joining tools cause the hollow shaft to expand only at the necessary points.

6 Claims, 3 Drawing Sheets

METHOD FOR NON-ROTATABLY CONNECTING A HOLLOW SHAFT WITH A COMPONENT

CROSS-REFERENCE TO A RELATED APPLICATION

The invention described and claimed hereinbelow is also described in German Patent Application DE 10 2005 039 784.0 filed on Aug. 22, 2005. This German Patent Application, whose subject matter is incorporated here by reference, provides the basis for a claim of priority of invention under 35 U.S.C. 119(a)-(d).

BACKGROUND OF THE INVENTION

The present invention relates to a method and a device for non-rotatably connecting a hollow shaft with at least one component located on the hollow shaft.

It is known from the related art, according to DE 196 25 555, to create "shaft-hub connections" by moving a mandrel inside a shaft body designed as a hollow shaft, the outer contours of which are designed such that they allow the hollow shaft to expand. In the exemplary embodiment shown, the mandrel is cylindrical in shape, and the outer diameter of the cylinder is greater than the inner diameter of the hollow shaft. To ensure that the mandrel can be placed in the hollow shaft, it includes a wedge-shaped or conical annular channel at one end that causes the hollow shaft to gradually expand to the outer diameter of the mandrel.

The main disadvantage of designs of this type is the fact that the hollow shaft must be expanded along its entire length, although the components to be fixed on the hollow shaft using a press fit are positioned only at certain points. The unnecessary expansion of the hollow shaft along its entire length slows the assembly process, increases the amount of energy required for the assembly process, and results in much higher wear of the assembly tools.

To reduce these disadvantages, and, in particular, to minimize tool wear, publication EP 0 650 550 discloses a method with which the hollow shaft includes a specially-shaped cross section that includes material accumulations in the region of the press fits to be formed. Given that the mandrel of the joining tool is now moved through the hollow shaft, material expands only in the areas where there are material accumulations, so that, with a method of this type, the press fits are realized only at the required points.

The main disadvantage of a method of this type is the complex manufacture of the hollow shaft, the special inner contour of which must be machined out either via mechanical machining or by using complicated forming tools during manufacture of the semi-finished product.

SUMMARY OF THE INVENTION

The object of the present invention, therefore, is to provide a shaft-component connection and its manufacture that prevents the described disadvantages of the related art and, in particular, is an economical alternative to known methods while ensuring low wear of the joining tools.

In keeping with these objects and with others which will become apparent hereinafter, one feature of the present invention resides, briefly stated in a method for non-rotatably connecting a hollow shaft with at least one component located on the hollow shaft, comprising the steps of positioning the component with clearance on the hollow shaft; fastening the component on the hollow shaft in a certain position by eliminating the clearance by expanding the hollow shaft using a joining tool that passes through at least part of the hollow shaft; providing in the joining tool at least one first shaping element and at least one further shaping element; moving the shaping elements relative to each other so that a motion of the shaping element relative to each other causes an at least partial expansion of the hollow shaft.

Another feature of the present invention resides, briefly stated, in a device for non-rotatably connecting a hollow shaft with at least one component located on the hollow shaft and positioned with clearance on the hollow shaft so as to be fastened on the hollow shaft in a certain position by eliminating the clearance by means of expanding the hollow shaft, comprising a joining tool that is passable and expands the hollow shaft for eliminating the clearance, said adjoining tool including an expansion mandrel defined by at least one first shaping element and at least one further shaping element, said extension mandrel being movable inside the hollow shaft; guide means for guiding said expansion mandrel during its movement inside the hollow shaft, said shaping elements being movable relative to each other so that a motion of said shaping elements relative to each other causes at least partial expansion of the hollow shaft.

Given that the joining tool includes at least one first shaping element and at least one further shaping element, and given that the shaping elements are movable relative to each other—the motion of the shaping elements relative to each other causing an at least partial expansion of the hollow shaft—it is ensured that the joining tools create press-fit connections only at the necessary points. This has the advantage, in particular, that an economical alternative to known methods is created that, in particular, ensures low wear of the joining tools.

A joining tool with a simple design and reliable operation is obtained when, in an advantageous embodiment of the present invention, the expansion of the hollow shaft is realized by expanding the shaping element that is in contact with a defined inner circumferential surface.

Great flexibility in the creation of the inventive press fits at any point along a hollow shaft is attained when the first and second shaping elements are capable of being moved in the direction of the longitudinal axis of the hollow shaft into any position inside the hollow shaft, and the first and second shaping elements enable an expansion of the hollow shaft in any of these positions.

An advantageous embodiment of the inventive method results when at least one shaping element is designed to be expandable and retractable in a manner that allows the shaping element to be displaced in the radial direction. This ensures that the joining tool has a compact design adapted to the inner diameter of the hollow shaft.

To ensure that the required quality of the press fit can be reliably determined, it is advantageous when the shape of the press fit between the hollow shaft and the component is defined by the shape of the contact surface of the at least one shaping element that is in contact with at least part of the inner surface of the hollow shaft.

An efficient method that can be easily integrated in automated manufacturing processes is attained in an advantageous embodiment of the present invention when the inventive method includes at least the following steps:

a) Position the further shaping element on the inner surface of the hollow shaft in the region of the component by moving the further shaping element inside the hollow shaft in a translatory manner b) Fix the further shaping element in this position c) Move at least part of the first shaping element inside the further shaping element by moving the first shaping element inside the hollow shaft in a translatory manner d) Moving at least part of the first shaping element inside the further shaping element causes the further shaping element to expand and, simultaneously, causes the hollow shaft to expand in this region e) Remove the first shaping element out of the further shaping element; the further shaping element retracts as a result f) Repeat steps a through e at a new position inside the hollow shaft.

Implementation of the inventive method using a compact design results when the joining tool includes an expansion mandrel composed of at least one first shaping element and at least one further shaping element, the expansion mandrel being movable inside a hollow shaft using guide means, the shaping elements being movable relative to each other, and the motion of the shaping elements relative to each other causing an at least part partial expansion of the hollow shaft.

The motion of the shaping elements relative to each other and the motion of the joining tool inside the hollow shaft can be realized particularly easily when, in an advantageous embodiment of the present invention, the at least one first shaping element is designed as a conical mandrel, the largest conical diameter of which is smaller than the inner diameter of the hollow shaft.

In an advantageous embodiment of the present invention, the translatory motion of the first shaping element can be realized using a simple design by the fact that a guide means designed as a connecting rod is integrally formed on the first shaping element, and by the fact that the connecting rod makes a translatory motion inside the hollow shaft via its coupling with a drive.

In an advantageous refinement of the present invention, the expansion of the hollow shaft—which is carried out to create the inventive press fit—can be ensured in a manner that is economical yet still ensures proper function by the fact that the at least one further shaping element is designed as an annular bushing formed by annular segments, and by the fact that the annular segments are movable to and fro in the radial direction of the annular bushing between a non-working position and at least one working position. In this context, it is advantageous when, in the non-working position, the outer diameter of the annular bushing is smaller than the inner diameter of the hollow shaft and, in the at least one working position, the outer diameter of the annular bushing is greater than the inner diameter of the hollow shaft.

In an advantageous embodiment of the present invention, the translatory motion of the further shaping element can be realized in a manner similar to that of the first shaping element using a simple design by the fact that a guide means designed as a support tube is integrally formed on the further shaping element, and by the fact that the support tube makes a translatory motion inside the hollow shaft via its coupling with a drive.

Given that the drive of the support tube is frame-mounted at one end and, at the other end, is coupled with a bracket fixed to the support tube, and given that the bracket simultaneously accommodates the drive of the first shaping element, it is ensured that the motion of the shaping elements relative to each other is enabled using a simple, space-saving design.

In an advantageous refinement of the present invention, to realize a precise motion of the shaping elements relative to each other and to ensure that strong shaping forces are transferred, the further shaping element is shaped such that the inner surfaces of the annular segments of the further shaping element define a truncated cone surface, the edge inclination angle of which corresponds to the edge inclination angle of the first shaping element designed as a conical mandrel.

To ensure that the inventive joining tool can be flexibly adapted to different inner diameters of hollow shafts, it can be provided in an advantageous embodiment of the present invention that the shaping elements and the guide means associated therewith are detachably interconnected and/or are located such that they touch each other. The particular advantage of this is that, when the joining tool is used in hollow shafts with a different inner diameter, it is only necessary to replace the mandrel and, optionally, the annular bushing. The need to replace the annular bushing could even be eliminated if the radial motion of the annular segments of the annular bushing takes place such that the required quality of the inventive press fit is attained even when different inner diameters of the hollow shaft are involved.

A particularly efficient implementation of the inventive method and the associated device is attained when the present invention is used—in the field of camshaft manufacture—to fix the cams to the camshaft.

Due to the very high requirements placed on the quality of press-fit connections, it is advantageous when the drives of the guide means are coupled to a control and evaluation unit, the control and evaluation unit controlling the motion of the shaping elements relative to each other as a function of characteristic curves stored in the control and regulating unit. This has the advantage, in particular, that the press-fit connections can always be manufactured with the same high level of quality, since electronic systems are better suited to reacting quickly and precisely to highly diverse basic conditions, so that, ultimately, the same high-quality working results can always be attained, even when the basic conditions fluctuate.

In this context, it is advantageous when the characteristic curves take the following into account: the position of the shaping elements, and the edge inclination angle and material characteristics of the hollow shaft and the components, it being possible for the material characteristics to include the elasticity module, density, temperature and/or material composition of the hollow shaft and/or the components.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
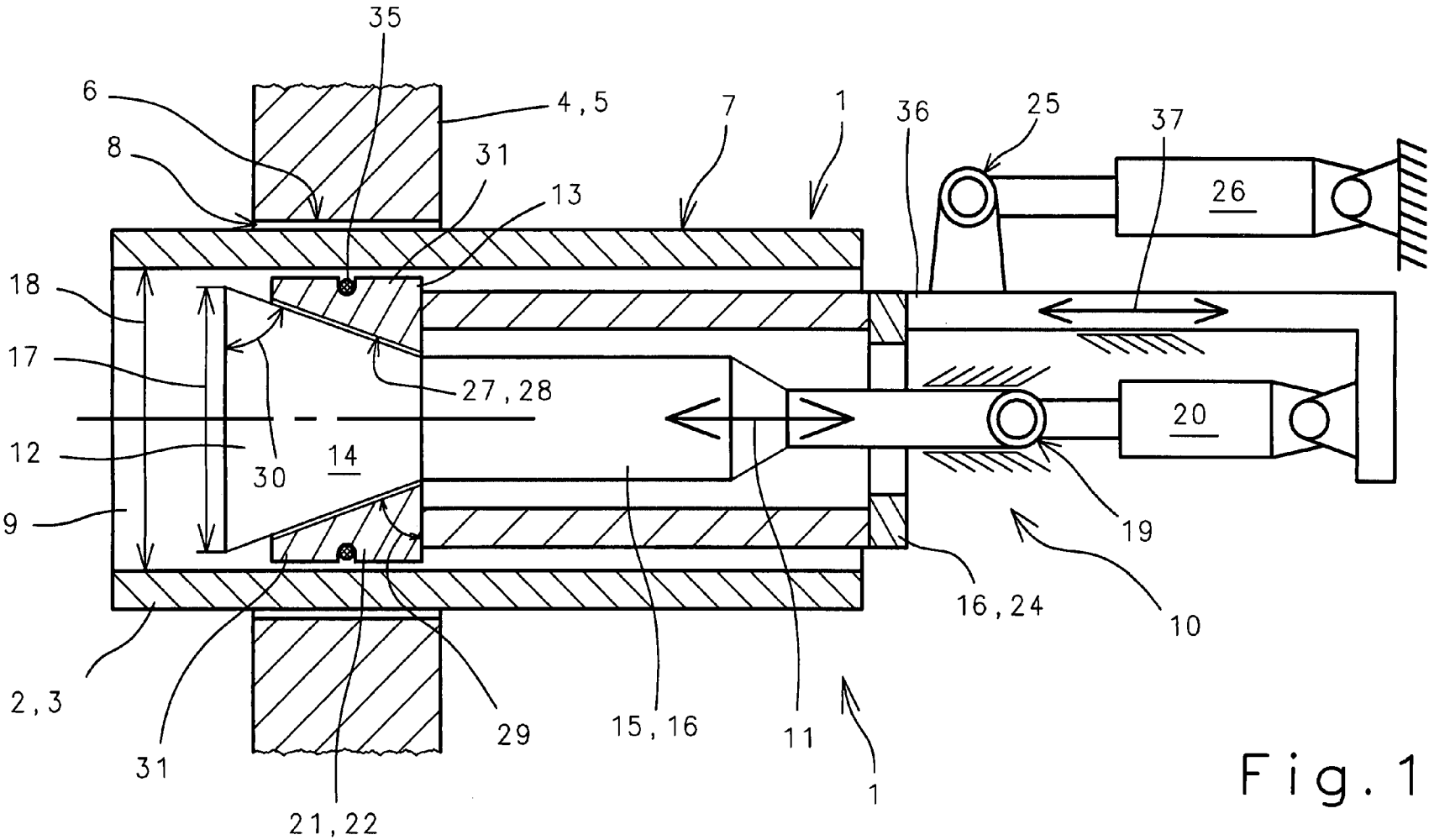
FIG. 1 shows the inventive joining tool in a non-working position, in a side view in accordance with the present invention.

FIG. 1 shows a section of a camshaft 1, the shaft body 2 of which is designed as a hollow shaft 3. At any position, hollow shaft 3 passes through a component 5 designed as a cam 4; component 5 is fixed to hollow shaft 3 using a press fit in a manner according to the present invention and to be described in greater detail below. To ensure that component 5 and hollow shaft 3 can be easily positioned initially in the correct position relative to each other in a manner that is known per se and will therefore not be described in greater detail, a bore 6 is formed in component 5, the diameter of bore 6 being greater than outer diameter 7 of hollow shaft 3, so that clearance 8 results between hollow shaft 3 and component 5.

Inventive joining tool 10 passes through at least part of inner space 9 of tubular hollow shaft 3, it being possible for joining tool 10 to make a translatory motion—in a manner to be described in greater detail—toward either end of hollow shaft 3, as indicated by direction arrow 11. Joining tool 10 is composed of at least one first shaping element 12 and at least one further shaping element 13. In the exemplary embodiment shown, first shaping element 12 is defined by a conical mandrel 14, on one end of which a guide means 16 designed as a connecting rod 15 is integrally formed. It is within the framework of the present invention for guide means 16 and mandrel 14 to be designed as a single component or, e.g., to be detachably interconnected via a not-shown thread.

The conical shape of mandrel 14 is selected such that the largest conical diameter 17 of mandrel 14 is smaller than inner diameter 18 of hollow shaft 3. At the end opposite from the mandrel, connecting rod 15 is coupled via interface elements 19 known per se with a drive 20 designed, e.g., as an electrically or hydraulically driven linear motor that can move the at least one first shaping element 12 inside hollow shaft 3 as indicated by arrow direction 11.

Figure 2:
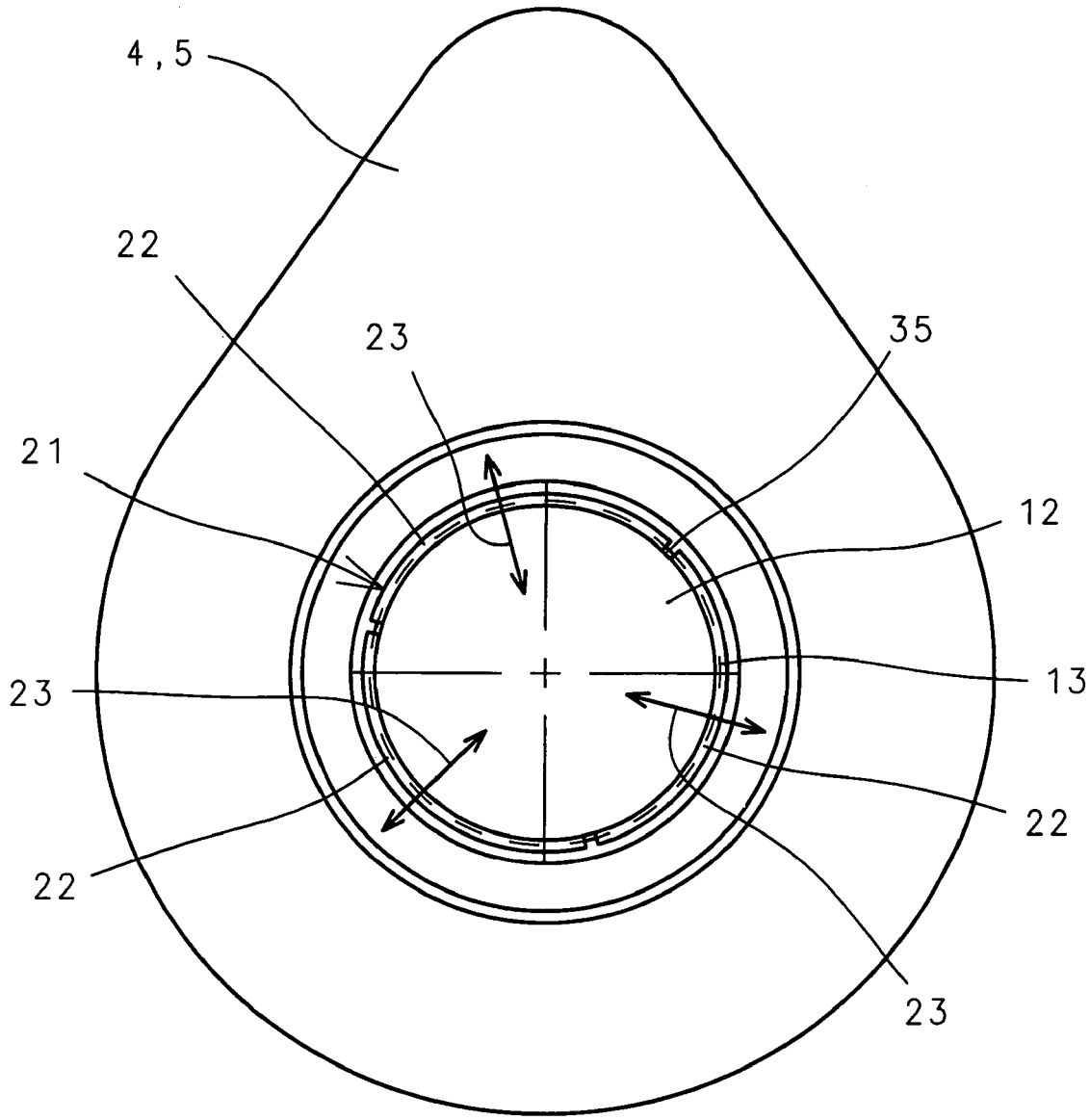
FIG. 2 shows the joining tool in FIG. 1, in a front view in accordance with the present invention.

The at least one further shaping element 13 is defined by an annular bushing 21, which is composed of a large number of annular segments 22, as shown in FIG. 2. Annular segments 22 are fixed in position in the circumferential direction using suitable fixing means 35, e.g., snap rings or O rings, such that they ensure a nearly annular shape of annular bushing 21 and also allow annular segments 22 to move in the radial direction as indicated by arrow direction 23.

Furthermore, a guide means 16 designed as a support tube 24 is assigned to annular segments 22 on an end face. A U-bent bracket 36 is assigned to support tube 24 at one end that, in a manner similar to connecting rod 15, couples support tube 24 via interface elements 25 known per se with a drive 26 designed, e.g., as an electrically or hydraulically driven linear motor. In this manner, annular bushing 21 can be fixed in position inside hollow shaft 3.

It is within the framework of the present invention for annular segments 22 of annular bushing 21 to be lockable with support tube 24 in a not-shown manner such that the at least one further shaping element 13 moves inside hollow shaft 3 as indicated by arrow direction 11 and can be brought into a new position. A simpler design results when drive 26 of support tube 24 is fixed to the frame and drive 20 of first shaping element 12 is hinge-mounted on bracket 36 connected with support tube 24. Displacement of shaping elements 12, 13 inside hollow shaft 3 can thereby be realized without any additional arrestment.

It is within the framework of the present invention for mandrel 14 and annular bushing 21 to each include described guide means 16 on each of their end faces, so that, instead of a drive and support on only one side, it is possible to realize a drive on both sides and support of shaping elements 12, 13 on both sides in order to ensure that joining tool 10 functions in a precise manner.

Furthermore, inner surfaces 27 of annular segments 22 of annular bushing 21 as a whole form the shape of a truncated cone 28. The orientation of truncated cone 28 is selected such that mandrel 14—which also has the shape of a truncated cone—of first shaping element 12 can move into and out of this truncated cone 28. A very effective relative motion between the two shaping elements 12, 13 can be attained when edge inclination angles 29, 30 of truncated cone 28 and mandrel 14 are nearly identical, so that mandrel 14 can penetrate annular bushing 21 entirely.

According to the inventive method for realizing a press fit between component 5 and a hollow shaft 3, the first step is to position component 5 on hollow shaft 3. In a manner known per se, this is accomplished by sliding component 5 onto hollow shaft 3 and fixing it in the desired joining position. Depending on the configuration, one or more components 5—which are designed, e.g., as cams 4 on a camshaft 1—can be positioned simultaneously or in succession on hollow shaft 3.

When components 5 are fixed in the correct position, further shaping element 13 is moved in a translatory manner into the region of component 5 by starting up drive 26 associated with further shaping element 13, the translatory motion being brought about, in the exemplary embodiment shown, by displacing bracket 36 associated with support tube 24 in arrow direction 37. Depending on the press fit geometry desired, the width of annular bushing 21 associated with further shaping element 13 can be equal to, greater than or less than the width of component 5.

Figure 3:
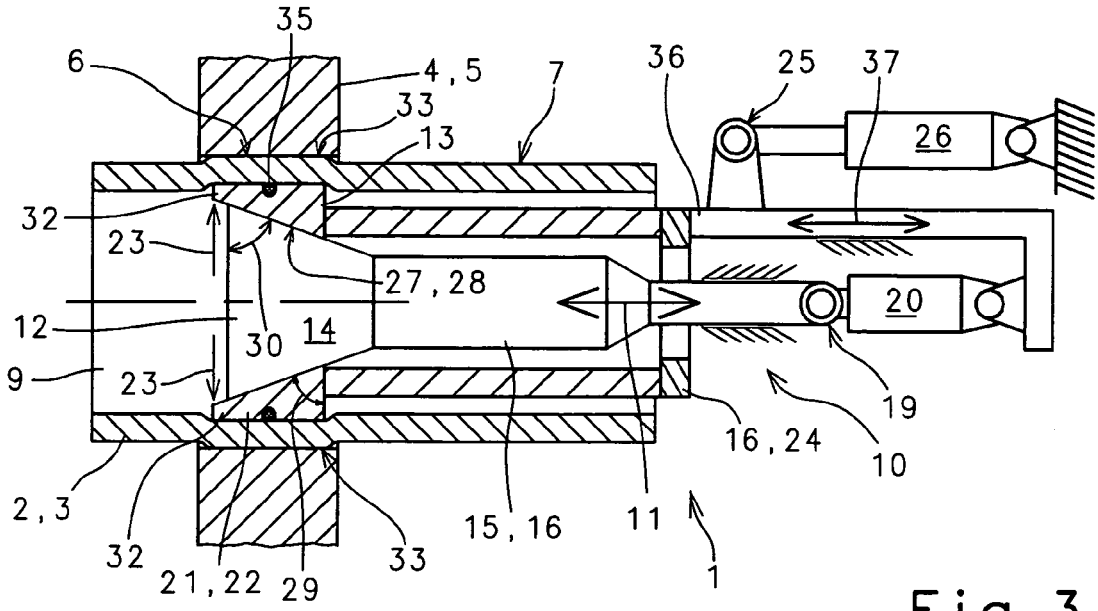
FIG. 3 shows the inventive joining tool in a working position, in a side view in accordance with the present invention.

In the next step, first shaping element 12 is also moved in a translatory manner inside hollow shaft 3 in the direction of annular bushing 21 of further shaping element 13 by starting up linear motor 20. As shown in FIG. 3, during this motion, mandrel 14 of first shaping element 12 enters annular bushing 21 of further shaping element 13. Given that edge angles 29, 30 of truncated conical mandrel 14 are matched to those of truncated conical recess 28 in annular bushing 21, annular segments 22—which are held together in an annular formation—of annular bushing 21 are moved outwardly in radial direction 23 from an inner non-working position 31 (FIG. 1) into a working position 32.

This results in deformation 33 of hollow shaft 3 in the areas where annular bushing of further shaping element 13 is in contact with the inside of hollow shaft 3. Deformation 33 spreads inside shaft body 2 of hollow shaft 3 in the radial direction such that outer diameter 7 of hollow shaft 3 is also expanded. Clearance 8 between component 5 and hollow shaft 3 is thereby eliminated and, depending on how far mandrel 14 penetrates annular bushing 21, a press fit that is more or less pronounced is formed between component 5 and hollow shaft 3.

Figure 4:
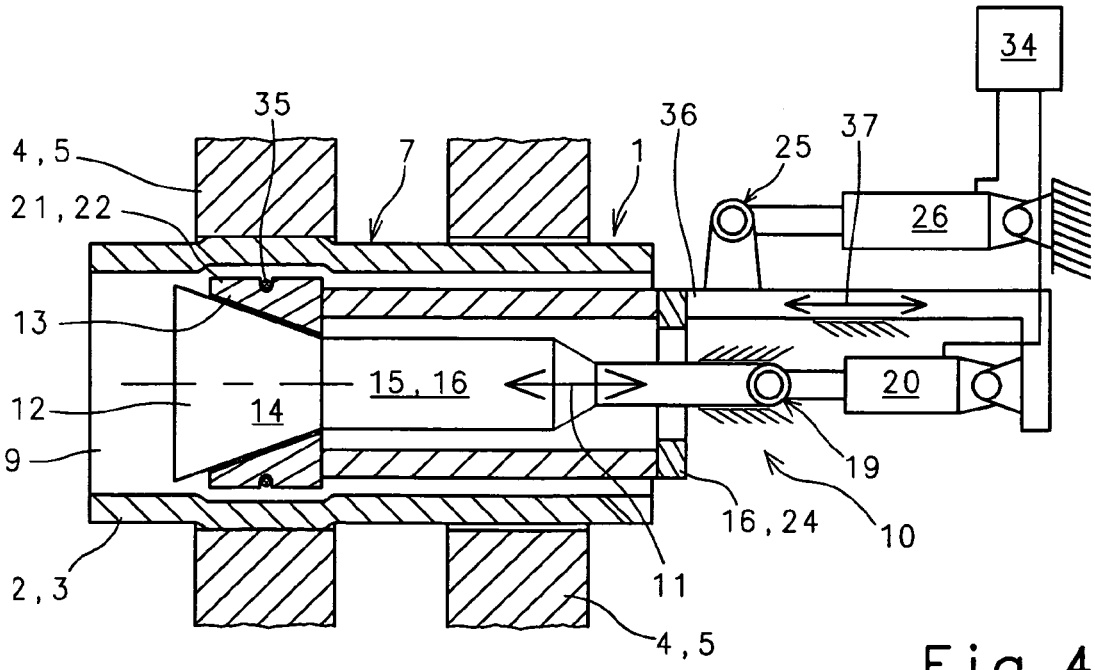
FIG. 4 shows the inventive joining tool in a further non-working position, in a side view in accordance with the present invention.

In a subsequent method step, as shown in FIG. 4, after the press fit connection is created, mandrel 14 is removed from annular bushing 21, so that annular segments 22 of annular bushing 21 return to their original, non-working position 31. In non-working position 31 of further shaping element 13, shaping elements 12, 13 of joining tool 10 can be moved inside the hollow shaft again, since the various outer diameters of shaping elements 12, 13 are now smaller than inner diameter 18 of the hollow shaft again. According to the method steps described above, shaping element 12, 13 can then be moved to the position of further component 5, where the inventive method for creating a press fit is repeated.

To create highly precise press fits, an electronic control and regulating unit 34 can be provided in a further embodiment of the present invention as shown in FIG. 4, in which characteristic curves are stored that define—as a function of translatory motion 11 of shaping elements 12, 13—edge inclination angles 29, 30 and material characteristics of hollow shaft body 2 and components 5, e.g., elasticity module, density, temperature, and material composition.

Using the characteristic curves, a position of shaping elements 12, 13 relative to each other that corresponds to the desired quality of the press fit is then determined, and the control of drives 20, 26 is actuated and monitored to attain these positions. In a preferred exemplary embodiment, the characteristic curves form a load displacement characteristic curve.

It is within the ability of one skilled in the art to modify the described formation of a press fit between a component 5 and a hollow shaft 3 in a manner not shown, or to use it in applications other than those shown here, in order to obtain the effects described, without leaving the scope of the present invention.

It will be understood that each of the elements described above, or two or more together, may also find a useful application in other types of constructions and methods differing from the types described above.

While the invention has been illustrated and described as embodied in a method and a device for non-rotatably connecting a hollow shaft with a component, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for non-rotatably connecting a hollow shaft with at least one component located on the hollow shaft using a press fit, comprising the steps of positioning the component with clearance on the hollow shaft; and connecting the component on the hollow shaft in a certain position by eliminating the clearance by expanding the hollow shaft using a joining tool, which comprises at least one first shaping element and at least one further shaping element, by passing the joining tool through at least part of the hollow shaft and moving the shaping elements relative to each other so that a motion of the shaping element relative to each other causes an at least partial expansion of the hollow shaft to realize the press fit.

2. A method as defined in claim 1; and further comprising realizing the expansion of the hollow shaft by expanding a shaping element that is in contact with the hollow shaft at a defined inner circumferential surface.

3. A method as defined in claim 1; and further comprising moving the first and second shaping elements in a direction of a longitudinal axis of the hollow shaft into any position inside the hollow shaft; and providing by the first and second shaping elements an expansion of the hollow shaft in any of these positions.

4. A method as defined in claim 1; and further comprising configuring at least one of the shaping elements as an expandable and retractable shaping element; and providing expansion and retraction of said at least one shaping element.

5. A method as defined in claim 1; and further comprising defining a shape of the press fit between the hollow shaft and the component by a shape of a contact area of at least one of said shaping elements that is in contact with at least part of an inner surface of the hollow shaft.

6. A method as defined in claim 1; and further comprising positioning the further shaping element on an inner surface of the hollow shaft in a region of the component using translatory motion of the further shaping element inside the hollow shaft;

fixing the further shaping element in this position;

moving at least part of the first shaping element inside the further shaping element using translatory motion of the first shaping element inside the hollow shaft;

causing expansion of the further shaping element and simultaneously expansion of the hollow shaft in this region by the moving at least part of the first shaping element inside the further shaping element;

removing the first shaping element out of the further shaping element;

retracting the further shaping element into a non-working position as a result; and repeating these steps at a new position inside the hollow shaft.

* * * * *